US007934915B2

(12) United States Patent
Sun

(10) Patent No.: US 7,934,915 B2
(45) Date of Patent: May 3, 2011

(54) VALVE ASSEMBLY FOR SCROLL COMPRESSOR

(75) Inventor: Zili Sun, Arkadelphia, AR (US)

(73) Assignee: Scroll Technologies, Arkadelphia, AK (US)

( * ) Notice: Subject to any disclaimer, the term of this patent is extended or adjusted under 35 U.S.C. 154(b) by 312 days.

(21) Appl. No.: 12/185,222

(22) Filed: Aug. 4, 2008

(65) Prior Publication Data

US 2010/0028183 A1 Feb. 4, 2010

(51) Int. Cl.
*F01C 1/02* (2006.01)
*F03C 2/00* (2006.01)

(52) U.S. Cl. ..... 418/55.1; 418/15; 418/270

(58) Field of Classification Search ..... 418/15, 418/55.1–55.6, 57, 270
See application file for complete search history.

(56) References Cited

U.S. PATENT DOCUMENTS 6,273,691 B1 * 8/2001 Morimoto et al. ..... 418/15
2006/0099098 A1 * 5/2006 Lee et al. ..... 418/55.1

FOREIGN PATENT DOCUMENTS

JP 59189968 U * 12/1984
JP 62243984 A * 10/1987
JP 02163486 A * 6/1990
JP 2004324485 A * 11/2004

* cited by examiner

*Primary Examiner* — Theresa Trieu
(74) *Attorney, Agent, or Firm* — Carlson, Gaskey & Olds

(57) ABSTRACT

A scroll compressor has a reed valve mounted on a central discharge port. The reed valve has a valve portion at a first end and a pin holding the reed valve onto a non-orbiting scroll member at a second end. The reed valve extends along a plane which is non-perpendicular to a drive axis of a drive shaft such that the second end, which receives the pin, is further removed from the compression chambers than is the first end of the reed valve, which covers the central discharge port.

2 Claims, 3 Drawing Sheets

VALVE ASSEMBLY FOR SCROLL COMPRESSOR

BACKGROUND OF THE INVENTION

This application relates to a discharge valve assembly for a scroll compressor wherein reed valves are pinned to a non-orbiting scroll body at one end, and have a flexible opposed end which can move away a discharge port. The valve body is positioned at an angle, such that the opposed end is closer to the compression chambers than is the one end of the body.

Scroll compressors are known, and have become widely accepted in the refrigerant compression art. In a typical scroll compressor, first and second scroll members orbit relative to each other. Each of the two scroll members have a base and a generally spiral wrap extending from the base. The wraps interfit to define compression chambers. One of the two scroll members is caused to orbit relative to the other, and as the orbiting relative movement occurs the size of the compression chambers is decreased. Eventually, the compression chambers communicate with a discharge port near a center of the scroll members.

The discharge port may be provided with a discharge valve, to control the discharge pressure which is delivered downstream into a discharge plenum.

Another feature of the scroll compressors is the provision of over pressure control valves. These control valves may be positioned slightly radially outwardly of the central discharge port. If the pressure becomes too high, these valves open and allow the high pressure refrigerant to enter the discharge plenum.

In scroll compressors, volumes in discharge ports, which are upstream of the valves, can cause gas re-expansion and associated re-expansion losses.

With scroll compressors there is a phenomenon known as "reverse rotation". Reverse rotation can occur when a scroll compressor stops being driven to orbit. A previously compressed refrigerant which is in the discharge port, and upstream of the discharge valve can re-expand and drive one scroll member in a reverse direction. This creates unwanted noise.

One way to minimize reverse rotation and re-expansion losses is to minimize the volume of the discharge port which is upstream of the valve. Various discharge valve types have been utilized. However, when a reed valve is utilized it is typically pinned to the base of a scroll member. A minimum thickness of material is required to receive the pin to hold the reed valve firmly.

SUMMARY OF THE INVENTION

In the disclosed embodiment of this invention, a reed valve for a discharge port in a scroll compressor extends on a plane which is at an angle which is non-perpendicular to a drive axis of a drive shaft for the scroll compressor. A pin for the reed valve is received at one end of the reed valve which is spaced further from the compression chambers, while the valve body itself is spaced closer to the compression chambers, to minimize the volume of refrigerant upstream of the valve body.

These and other features of the present invention can be best understood from the following specification and drawings, the following of which is a brief description.

DETAILED DESCRIPTION OF THE PREFERRED EMBODIMENT

Figure 1:
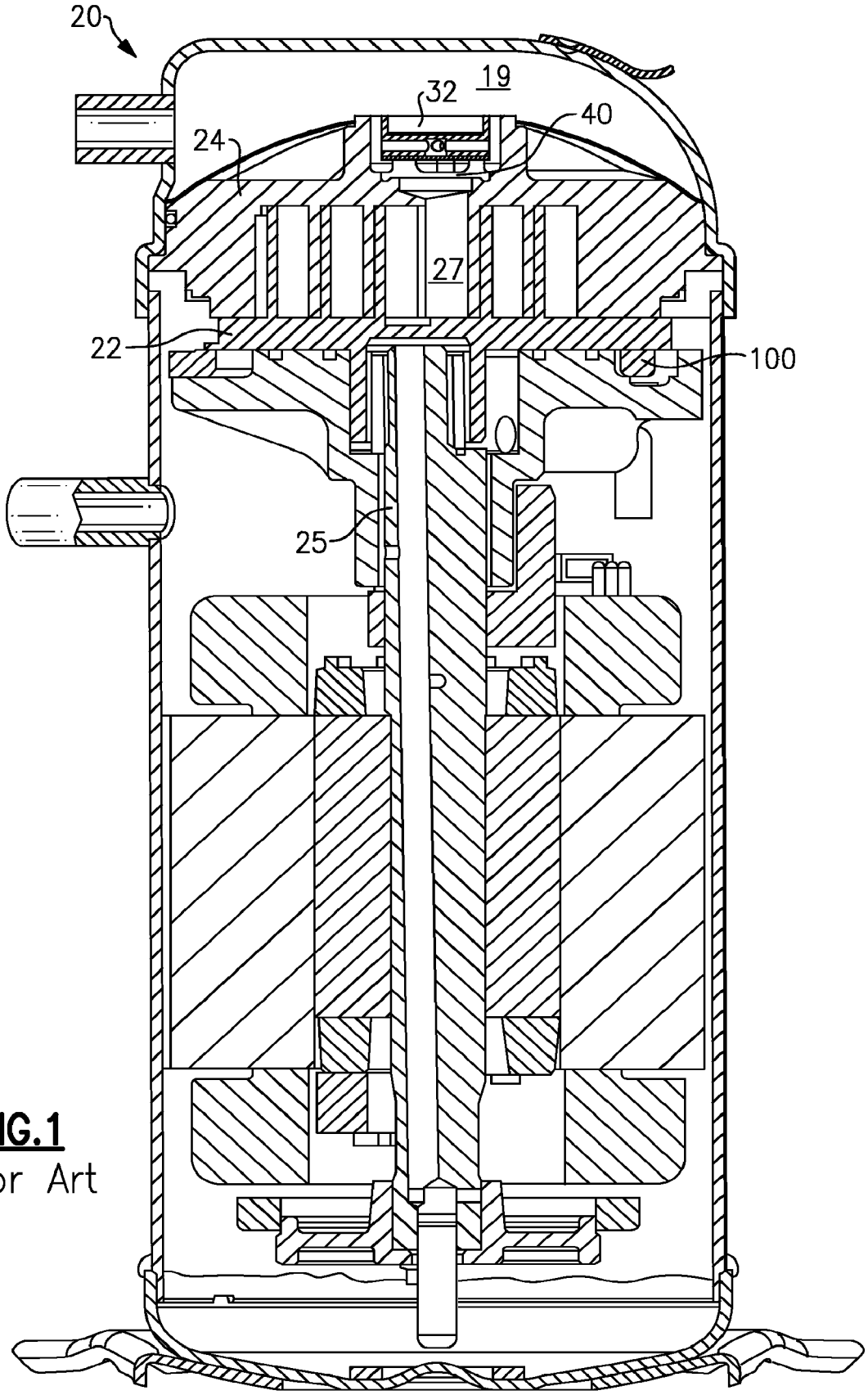
FIG.1 Prior Art
FIG. 1 shows a prior art scroll compressor

A scroll compressor 20 as known in the art is shown in FIG. 1. A non-orbiting scroll member 24 is associated with an orbiting scroll member 22. The orbiting scroll member 22 is driven by a shaft 25 to cause the orbiting scroll member 22 to orbit relative to the non-orbiting scroll member 24. As known, a non-rotation coupling 100 constrains the orbiting scroll member 24 to orbit. In this manner, compression chambers 27 between the two become smaller, and an entrapped refrigerant is compressed and moves towards a discharge port 40. A valve 32 is shown on the discharge port 40. The above discussed scroll compressor is a generally known in the art.

Figure 2:
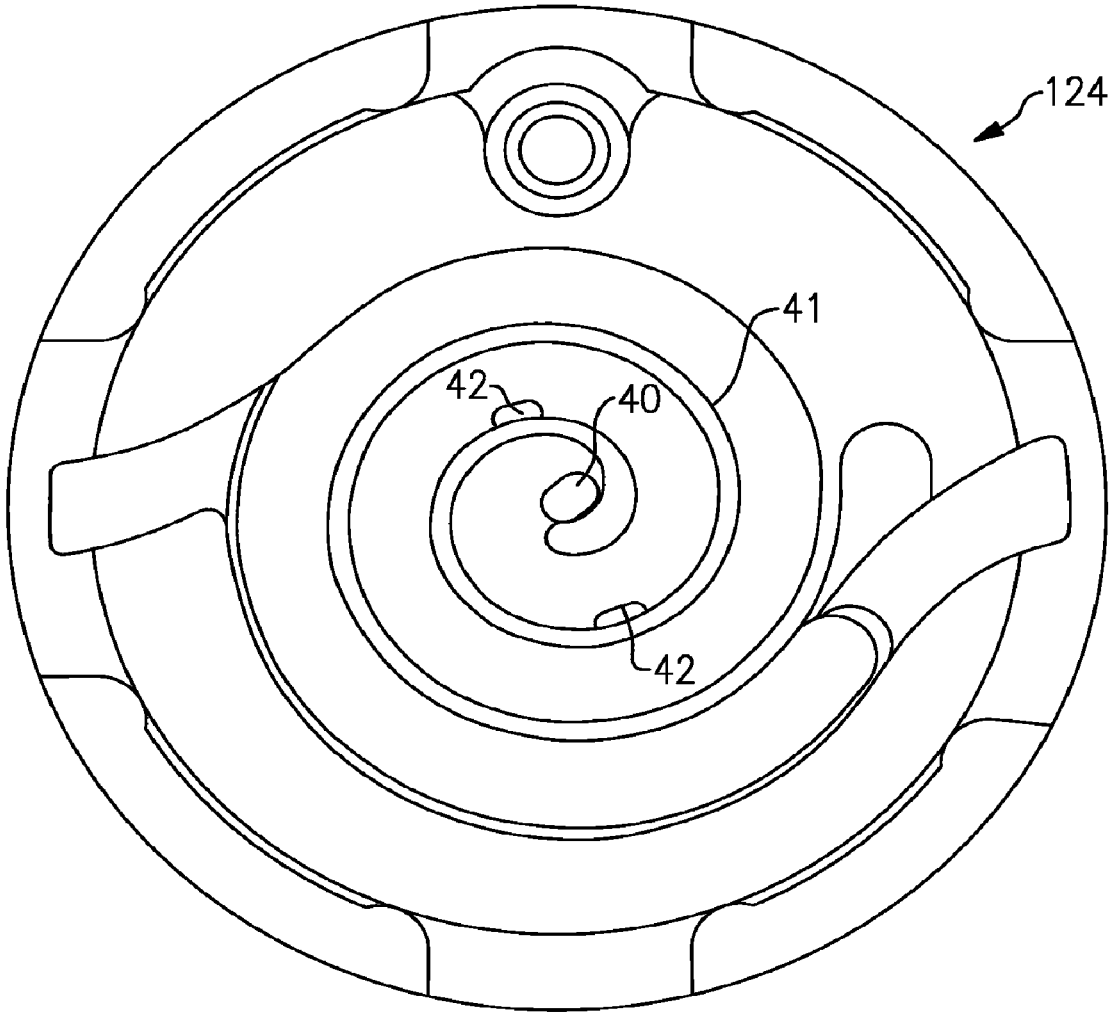
FIG. 2 shows a scroll member having a plurality of discharge ports.

FIG. 2 shows a non-orbiting member 124. In the non-orbiting scroll member 124 the discharge port 40 is formed at a central location relative to the wrap 41 of the non-orbiting scroll member. In addition, two over pressure ports 42 are also shown.

Figure 3:
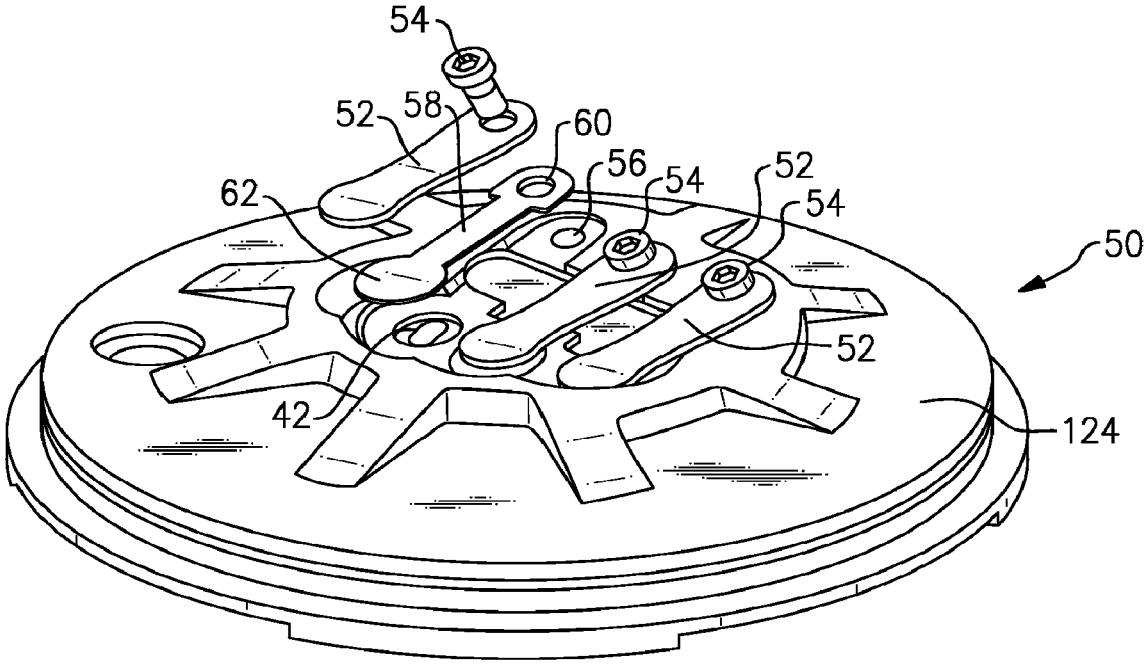
FIG. 3 shows the inventive scroll member.

FIG. 3 shows a valve arrangement 50 on the non-orbiting scroll 124. As shown, a plurality of valve stops 52 receive pins 54. Reed valves 58 include holes 60 to receive the pins 54. A remote end 62 of the valve covers the ports 40 and 42.

Now, as the orbiting scroll member orbits relative the non-orbiting scroll member, should the pressure become unduly high prior to reaching the central discharge port 40, then the ports 42 will open with their valve body 62 moving away from the ports 42 and allowing the refrigerant to enter a discharge plenum 19 (FIG. 1), before the refrigerant would normally exit through the central discharge port 40.

Figure 4:
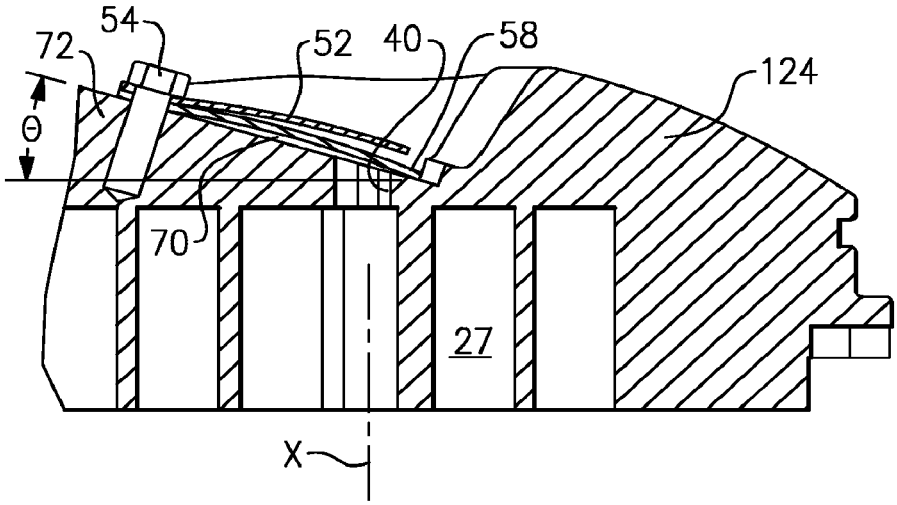
FIG. 4 is a cross-sectional view through a portion of the non-orbiting scroll member.

FIG. 4 shows an inventive feature in which the pin 54 is formed through a relatively thick portion 72 of the base of the non-orbiting scroll member 124. The valve body 58 extends downwardly at a plane along a face 70 which extends towards the compression chambers 27. The plane is non-perpendicular to a drive axis X of the driveshaft 25. Preferably, the angle $\theta$ is between 0 and 60 degrees. In this manner, the volume of the discharge port 40 is smaller than if the disk valve 58 were to extend perpendicular to the drive axis of the drive shaft 25. The same is true of the valves on discharge ports 42. As is clear from the FIGS. 2 and 4, the discharge port 40 extends along an axis which is parallel to the drive axis X. The valve body 58, and the face 70, are non-perpendicular to the center of the discharge port. Thus, the magnitude of reverse rotation and re-expansion losses which can be expected will be reduced.

While a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from its base, said wraps of said first and second scroll members interfitting to define compression chambers;

a drive shaft for rotating about a drive axis, and causing said second scroll member to orbit relative to said first scroll member;

said first scroll member having a central discharge port extending through said base and into a discharge plenum;

a reed valve on said central discharge port, said reed valve having a valve portion at a first end and a pin holding said reed valve onto said base of said first scroll member at a second end, said reed valve extending along a plane which is non-perpendicular relative to said drive axis of said drive shaft such that said second end is further removed from said compression chambers than is said first end which covers said central discharge port;

said central discharge port extending along a port axis which is parallel to the drive axis, said reed valve being non-perpendicular to said port axis; and there is at least one over-pressure discharge port spaced radially outwardly of a location of said central discharge port, and there being a second reed valve having a similar orientation as first reed valve covering said at least one over-pressure discharge port.

2. The scroll compressor as set forth in claim 1, wherein there are two of said over-pressure discharge ports spaced on opposed radial sides of said central discharge port and each receiving a reed valve with a similar orientation.

* * * * *